US010519728B2

(12) United States Patent
Sopracolle

(10) Patent No.: US 10,519,728 B2
(45) Date of Patent: Dec. 31, 2019

(54) STANDING PIPE RACK BACK SYSTEM

(71) Applicant: GOLIATH SNUBBING LTD., Red Deer (CA)

(72) Inventor: Trevor Sopracolle, Red Deer (CA)

(73) Assignee: GOLIATH SNUBBING LTD., Red Deer (CA)

( * ) Notice: Subject to any disclaimer, the term of this patent is extended or adjusted under 35 U.S.C. 154(b) by 10 days.

(21) Appl. No.: 15/452,488

(22) Filed: Mar. 7, 2017

(65) Prior Publication Data

US 2017/0254161 A1 Sep. 7, 2017

Related U.S. Application Data

(60) Provisional application No. 62/304,866, filed on Mar. 7, 2016.

(51) Int. Cl.
*E21B 19/06* (2006.01)
*E21B 19/14* (2006.01)

(52) U.S. Cl.
CPC ..... *E21B 19/14* (2013.01); *E21B 19/06* (2013.01)

(58) Field of Classification Search
CPC ..... E21B 19/06; E21B 19/14
See application file for complete search history.

(56) References Cited

U.S. PATENT DOCUMENTS 2,505,087 A 4/1950 Athy et al.
3,857,450 A * 12/1974 Guier ..... E21B 19/06 173/215
3,915,244 A * 10/1975 Brown ..... E21B 19/07 166/77.52
4,042,123 A 8/1977 Sheldon et al.
4,269,554 A * 5/1981 Jackson ..... E21B 19/14 294/102.2
4,793,422 A * 12/1988 Krasnov ..... E21B 19/20 175/113
6,158,516 A 12/2000 Smith et al.
6,581,698 B1 6/2003 Dirks
6,679,333 B2 * 1/2004 York ..... E21B 19/084 166/379
7,021,374 B2 * 4/2006 Pietras ..... E21B 19/06 166/77.51
7,140,443 B2 * 11/2006 Beierbach ..... E21B 19/06 166/380

(Continued)

OTHER PUBLICATIONS

Vertical Pipe Racking Adds Tubular Handling Options, Phil Vollands, Varco Systems, Sep./Oct. 2000.

(Continued)

*Primary Examiner* — Matthew R Buck
(74) *Attorney, Agent, or Firm* — Bennett Jones LLP

(57) ABSTRACT

A manipulable elevator system for jointed tubulars on a service, work-over or completion rig which moves the elevator and any tubing grasped by the elevator away from (or toward) the centre-line of a wellbore being served by the rig is provided which permits use of a vertical pipe racking without the need for a rig worker to man the monkey-board, especially useful to provide for safe vertical pipe-racking for pressure-controlled or snubbing rig environments, and saving operational time and expediting turnaround back to production, while maintaining operational safety; the elevator's maneuvering controlled remotely, typically powered hydraulically.

5 Claims, 14 Drawing Sheets

(56) References Cited

U.S. PATENT DOCUMENTS

| | | | | |
|---|---|---|---|---|
| 7,377,324 | B2 * | 5/2008 | Beierbach | E21B 19/06 166/380 |
| 7,984,757 | B1 * | 7/2011 | Keast | E21B 19/02 166/75.11 |
| 8,074,711 | B2 * | 12/2011 | Ellis | E21B 19/07 166/77.51 |
| 8,215,687 | B2 * | 7/2012 | Pietras | E21B 19/06 294/116 |
| 9,759,019 | B2 * | 9/2017 | Sulima | E21B 19/16 |
| 2007/0251700 | A1 * | 11/2007 | Mason | E21B 19/06 166/379 |

OTHER PUBLICATIONS

Rack Jack Vertical Pipe Racking and Skidding System, Cudd Energy Services, 2015.
Design of Automatic Vertical Pipe Rack for Oilfield Tubing String, Yuan Jianmin, Huanghe Drilling Company, Apr. 2006.

* cited by examiner

STANDING PIPE RACK BACK SYSTEM

This application claims the benefit of U.S. provisional patent application No. 62/304,866 filed Mar. 7, 2016.

FIELD OF THE INVENTION

A manipulable elevator system is provided for a rig such as a snubbing or work-over/completion rig for the petroleum extraction industry, which permits use of a vertical pipe racking system (called a Standing Pipe Rack Back system) for jointed tubulars on a work-over or completion rig, especially useful to provide a safe vertical pipe-racking system for pressure-controlled or snubbing rig environments, without the need for a rig worker to man the monkey-board, saving operational time and expediting turnaround back to production, while maintaining operational safety.

BACKGROUND OF THE INVENTION

There is prior art having to do with top-drive rigs with vertical pipe stacking U.S. Pat. No. 7,021,374 Weatherford ('374), as well as a system designed for snubbing and work-over rigs U.S. Pat. No. 6,158,516 Cudd Pressure Control ('516), and a more general pipe-racking system U.S. Pat. No. 4,042,123 Sheldon et al ('123).

There are, however, significant differences between these systems and this invention.

For instance, '374 Weatherford deals with a top-drive system, and thus has drive equipment which must align with the upper box-end of the tubing in the elevator, inside the drive unit, and the drive unit itself is integrated in the top-end. The similarity ends with the use of hydraulic rains connected to an off-set at the upper end of the bails and to the bails themselves lower down, to effect some vertical displacement. This is not exactly the same as this invention, and takes place in a completely different working environment, although the Weatherford's hydraulic offset device has some similarities, it is effected in a different manner, on a different rig type, with a different drive system.

A block-retracting linkage between a vertical rail offset from the well's centre line and a travelling block is provided in '123 Sheldon, with a number (3) of hydraulic rams which can be actuated to move the block (and any suspended tubulars) off the well's centre line and toward and to a vertical pipe-rack means. This is different from the hydraulic bail/ram system of this invention in that the block in the system of this invention is suspended and not held by a rail-based mechanical setup.

In '516 Cudd, a combination coiled-tubing and rack-back jointed tubing rig is described, but without details of the elevator and racking system. This is relevant in that the type of tubular is commonly seen in pressure-controlled well settings, but Cudd does not disclose a hydraulic-ram bail swing system, and so is merely cited as a reference to similar rig environments in the prior art with rack-back tubular systems.

SUMMARY OF THE INVENTION

A manipulable elevator system for jointed tubulars on a rig which moves the elevator and any tubing grasped by the elevator away from (or toward) the centre-line of a wellbore being served by the rig is provided which permits use of vertical pipe racking without the need for a rig worker to man the monkey-board, especially useful to provide for safe vertical pipe-racking for pressure-controlled or snubbing rig environments, and saving operational time and expediting turnaround back to production, while maintaining operational safety; the elevator's maneuvering is controlled remotely, typically powered hydraulically.

The invention of this application, in an embodiment, may be described as follows:

1. A manipulable elevator for well operations with a work-over or completion rig to facilitate vertical racking of jointed tubulars, the elevator comprising:
   (a) Remotely operable means for the elevator to grasp or release jointed tubulars
   (b) Remotely operable means to move the grasping means and any suspended grasped tubular away from vertical alignment with the well's centre-line.
2. The elevator of paragraph 1 where remote operations are controlled away from the well's monkeyboard.
3. The elevator of paragraph 1 where the means to move the grasping means and suspended grasped tubulars away from vertical alignment with the well's centre-line comprises:
   (a) Where the well's operating equipment has a draw-works with winch, cable/tackle, an upper block and a travelling block suspended by the cable/tackle, the elevator is suspended from and below the travelling block by bails;
   (b) Each bail comprises an eye or fastener at its upper end, a middle elongated body, and a lower eye or faster at its lower end;
   (c) The travelling block has a connector for each bail, or hook/ear at or near each side of the lower end of the block, for receiving the upper eye or fastener of a bail;
   to (d) The elevator is suspended from and attached to the lower eye or fastener of each bail;
   (e) At or near each hook or ear of the travelling block is an off-set device, attached to the hook or eye, or to the block on one side, and carrying a hinge-point on another side, the hinge-point off-set vertically from the block;
   (f) To each hinge-point is hingedly attached the upper end of a jack;
   (g) The lower end of each jack is attached to the middle elongated body of a bail, each jack being attached to its bail at about the same point on each bail's body;
   (h) The jacks are powered to extend or retract, causing the remotely operated movement of the suspended grasping means and any suspended tubular away from vertical alignment with the well's centre-line,
4. The elevator of paragraph 3 where the grasping means is hydraulically powered and controlled.
5. The elevator of paragraph 3 where the jacks' extension and retraction is powered and controlled hydraulically.
6. The elevator of paragraph 3 where there is an alignment and retention device deployed between the upper eye of each bail and the hook or ear from which the bail is suspended, comprising:
   (a) A plate with a mating plate, the two plates attached to opposite sides of the upper eye of a bail, and between which is affixed a compressible spacer;
   (b) The spacer is sized and placed to fill or nearly fill the gap between the lower inner surface of the hook or ear, and the upper inner surface of the eye of the bail.
7. The elevator of paragraph 3 where there is an added trough, spoon or guide mounted at about the same level as the lower end of the travelling block and around the level of the upper eye of the bails, to guide the upper end of a joint or double-joint of a jointed tubular toward and into the grasping means of the elevator.

DETAILED DESCRIPTION OF THE INVENTION

Figure 1:
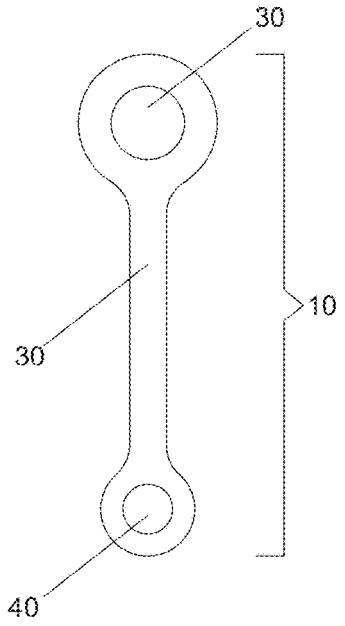
FIG. 1 shows a bail.
Figure 2A:
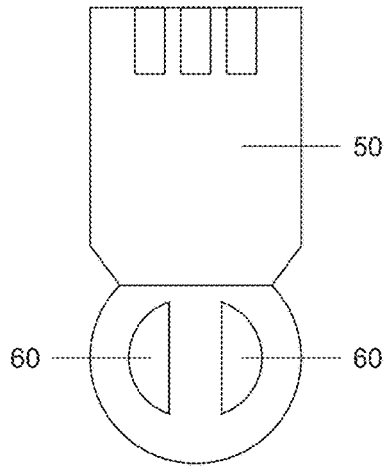
FIG. 2A shows a block with hook/ear.
Figure 2B:
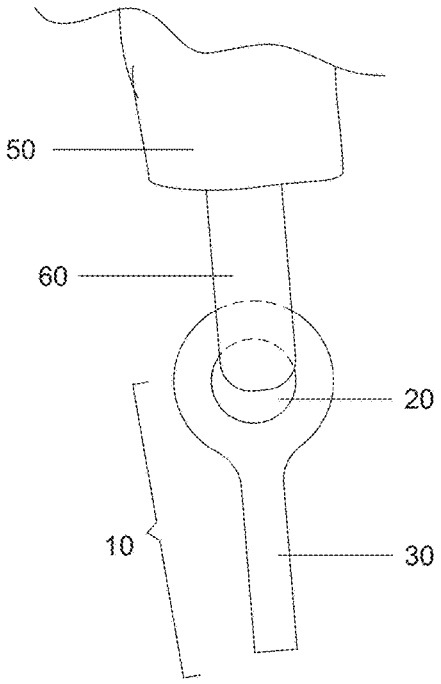
FIG. 2B shows a block with attached bail.
Figure 2C:
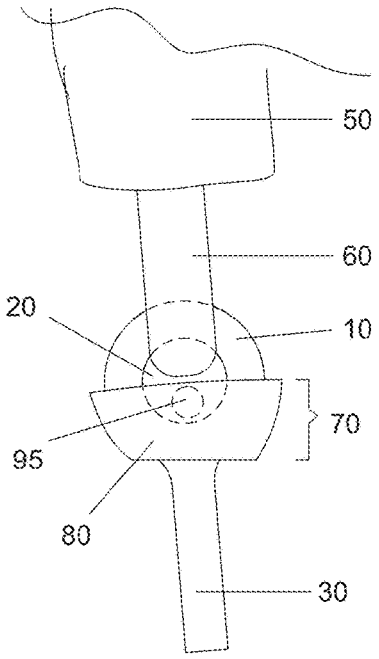
FIG. 2C shows the same but with a deployed deformable spacer with plates for mounting.
Figure 3B:
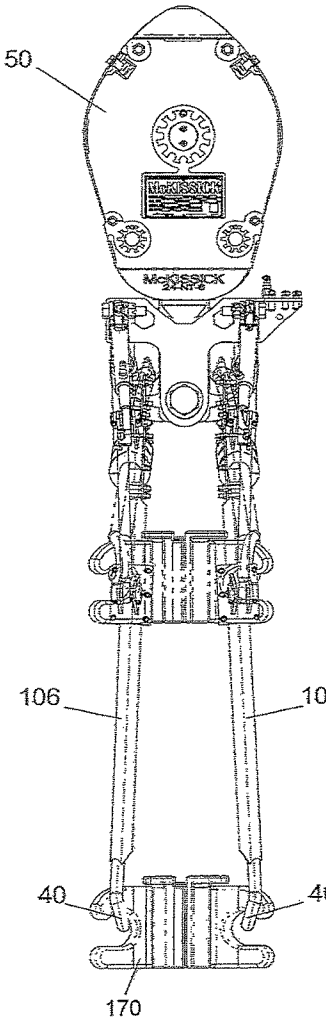
FIG. 3B showing a front-on perspective.
Figure 3A:
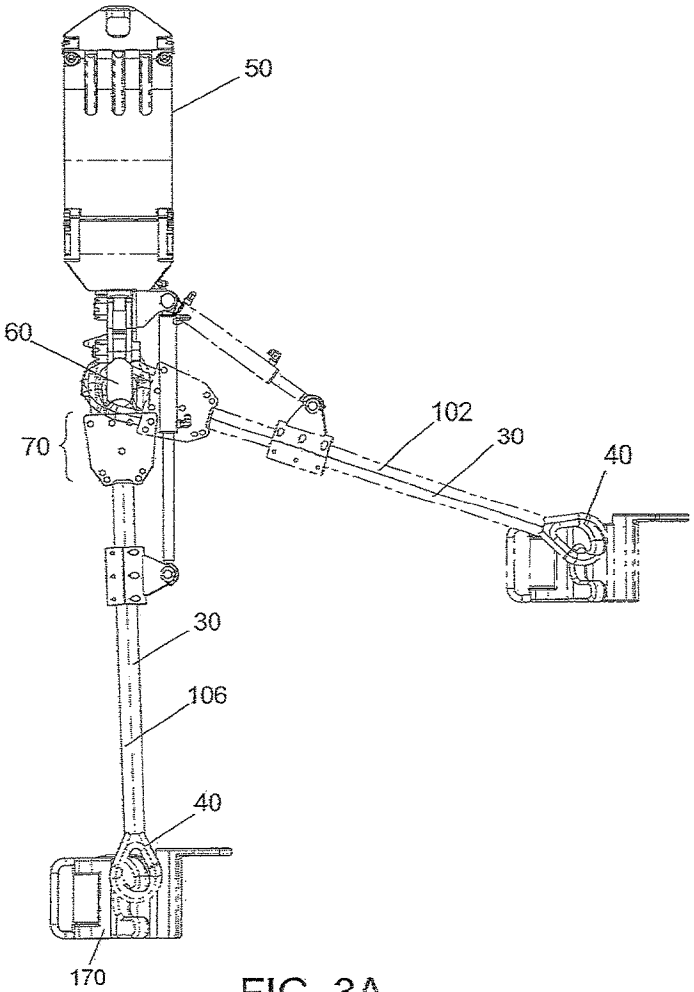
FIG. 3 shows the apparatus of the invention in several aspects, FIG. 3A from a side showing the bails deviated from horizontal and also not deviated.
FIG. 3C showing the apparatus with rams retracted and bails deviated.
Figure 3C:
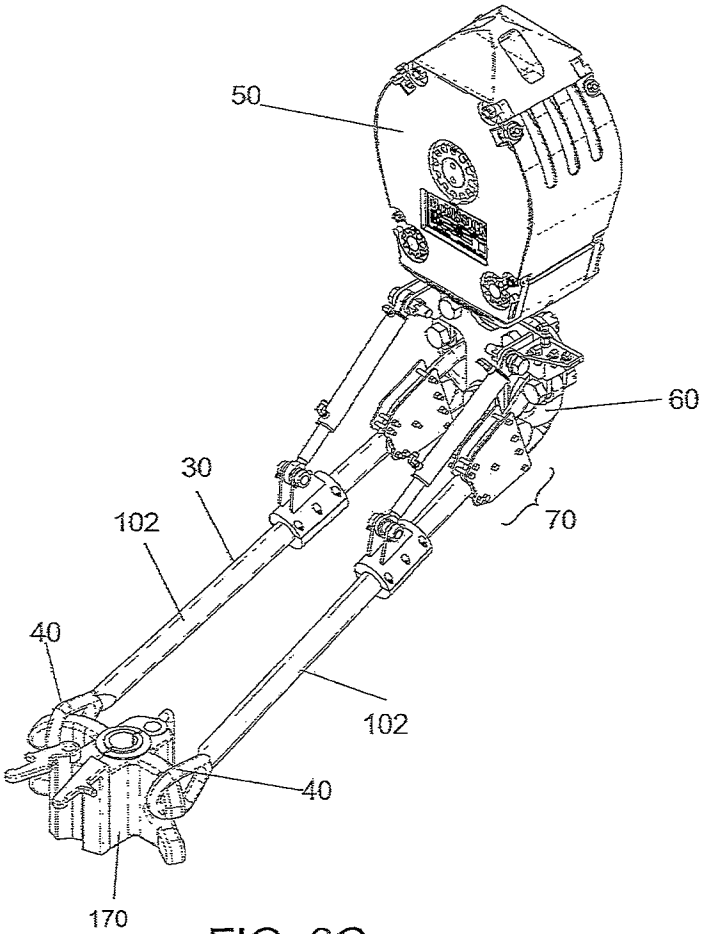
Figure 4:
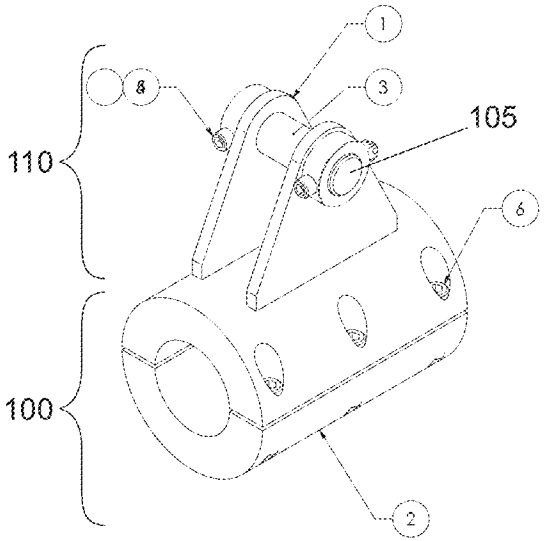
FIG. 4 shows several elevations of a mount for the hinged attachment for the lower part of the ram to be attached to the middle of a bail.
Figure 4:
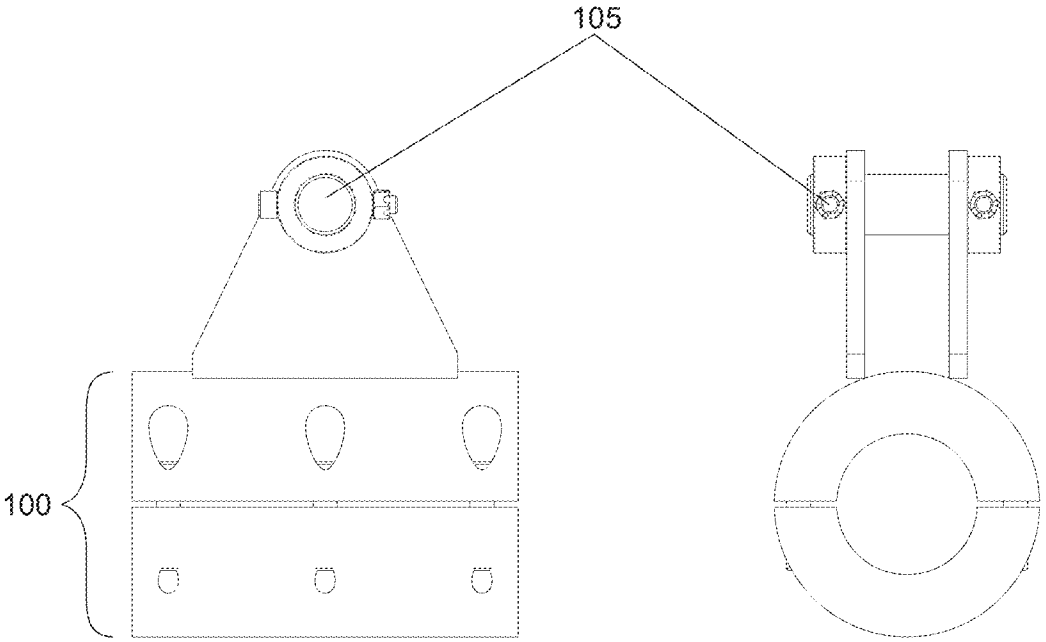
Figure 5:
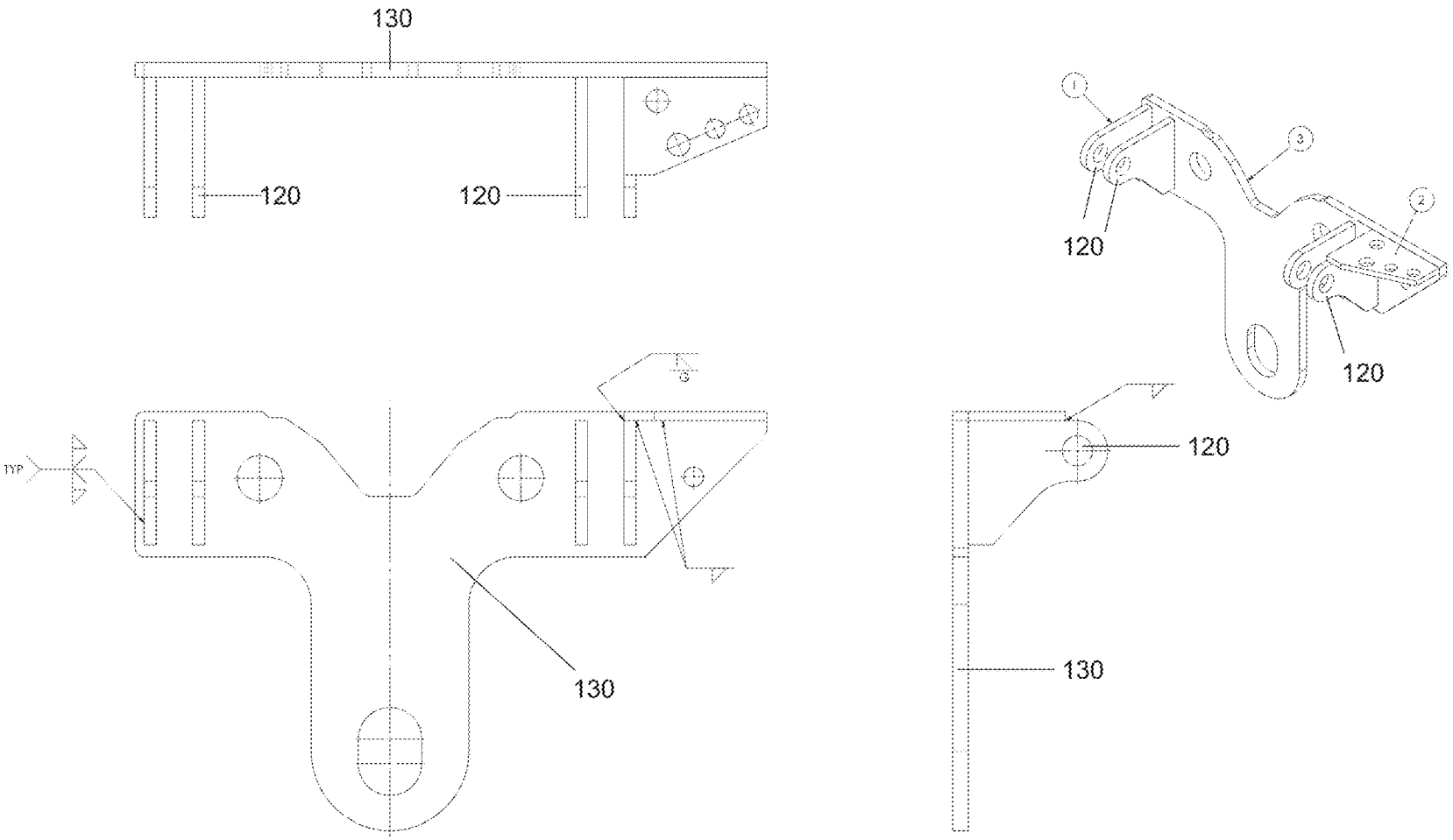
FIG. 5 shows a block cylinder mount to offset the hinge between the upper part of a rain and the lower part of the travelling block near the ears.
Figure 6A:
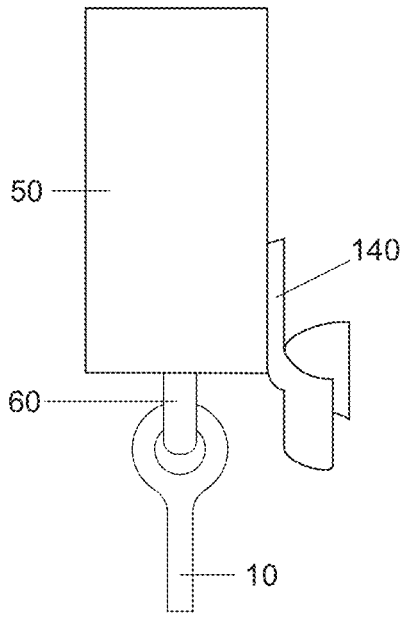
FIG. 6A from RHside elevation and FIG. 6B from above.
Figure 6B:
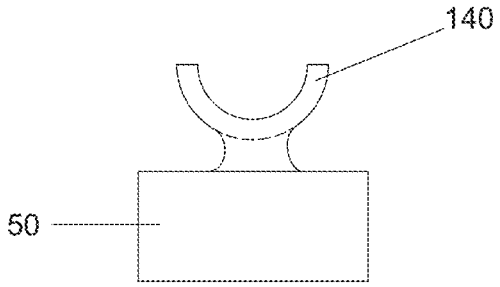
FIG. 6 shows an embodiment of the guide or tubular catcher from two views.
Figure 7:
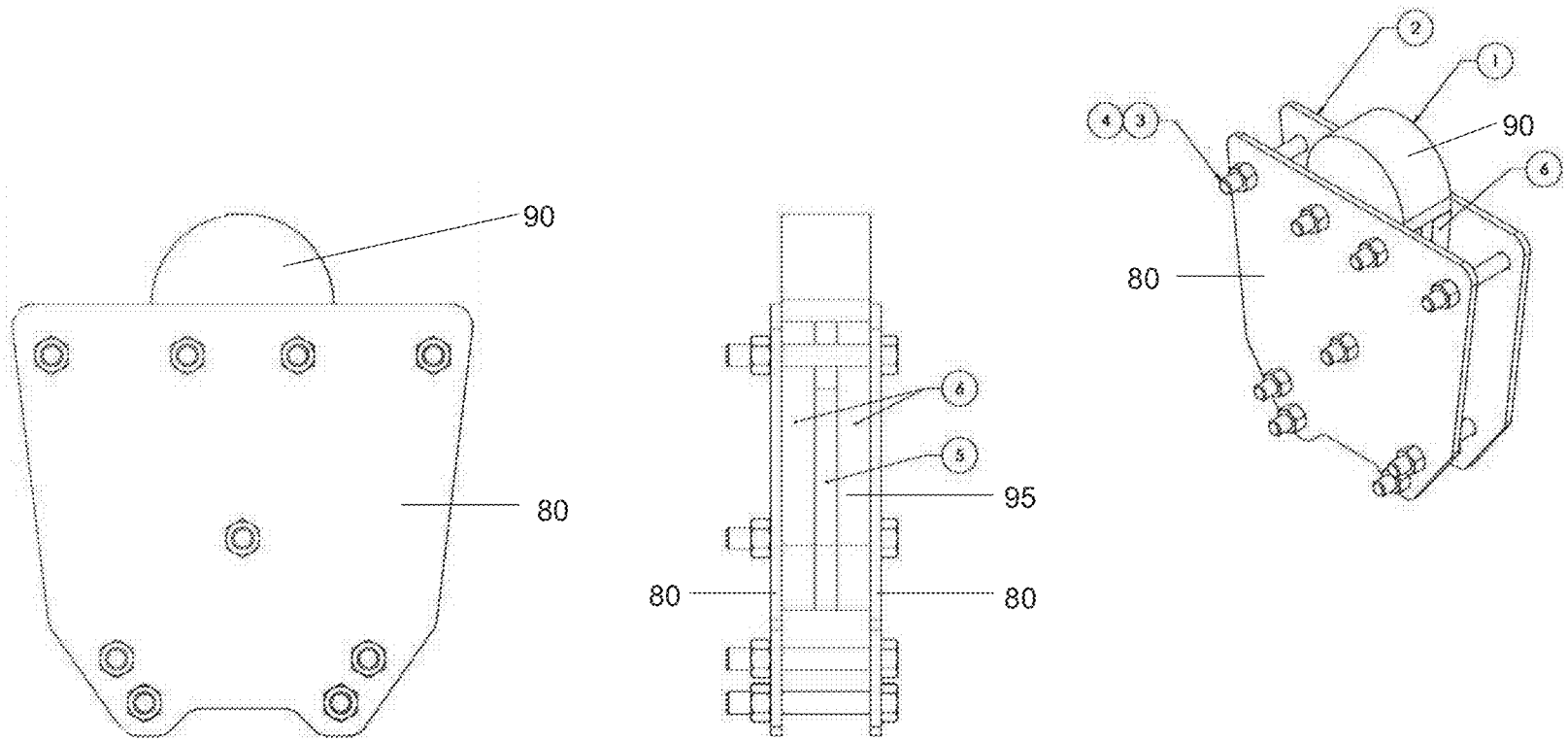
FIG. 7 shows several aspects of the deformable spacer and mounting plate, also called the link reactor assembly.

The invention has to do with a remotely operated rig-based tubular elevator system which can be used to manipulate the centering of the elevator just below a travelling block in order to in turn manipulate tubing suspended from the elevator to be more or less off-centre of the rig's operational centre-line. This provides a means of remotely handling the tubulars so that they may be vertically racked in an efficient manner. The remote control nature of the system permits it to be controlled without having a man on the rig's monkey-board, which is unsafe and in most places illegal if the rig is on a pressure-controlled well bore. There are additional features to the device and its operation to provide stability, reduce erratic operation, and assist the remote operator in aiming the elevator at the top-end of a tubing joint (or double-joint).

An elevator 170 is provided which can be opened and closed by remote control, typically comprising hydraulic-powered jaws with remote operator controls. The elevator 170 is hung from bails 10 suspended from a swivel/hook 60 just below the block 50. The angle between the bails 10 and vertical may be adjusted by extending or retracting one or more arms 160 connected near to the swivel/hook 60 but horizontally offset a suitable small distance from vertical 115 at the swivel hook 60 by means of an offset device or block cylinder mount 110, the arms 160 typically being hydraulically powered and controlled jacks or rams 160.

Where the bails 10 are hingedly connected to the hook 60 of the swivel and the block 50, a set of stabilizing means or link reaction assemblies 70 may also be affixed to the upper eye 20 of each bail. The stabilizing means 170 on each bail's eye 20 may include one or more compressible or plastic roller 90, 95 deployed between the upper-facing inside surface of the eye 20 and the lower-facing inside surface of the mating hook 60. In addition, the roller 90, 95 is affixed between two plates 80 sandwiching the bail's 10 upper eye 20. This arrangement provides a roller 90, 95 to act as a bumper between the bail 10 and the mating hook 60, so that when the arms (bails 10 and rams 160) are manipulated, for example by extending or retracting hydraulically controlled and powered jacks 160, the bail 10 rotates from its hanging position on the hook 60 without being vertically displaced, due to the removal of slack between the eye 20 of the bail 10 and the eye of the hook 60. In other words, the hinge is tightened so that manipulation of the angle of the bail 10 from vertical does not jump or become unstable or unpredictable by application of force by the hydraulic jack 160 control and displacement means.

By extending and retracting the hydraulic jack/arms 160, the elevator 170 may be swung away from directly vertically below the swivel and block 50, and toward a storage area 210 set aside on or near the drilling rig floor, to move tubulars 180 out of the way of operations centred on the well-head (and in the reverse operation, to move tubulars 180 from vertical storage 210 off-center of the well-head to swing toward and be stabbed into the wellhead connection below the block 50). This permits the tubulars 180 to be removed from the well and stacked vertically without an extra rig-hand, out of the way of further operations. Additionally, it permits tubulars 180 standing by the well-head against pipe rack 190 on or near a stand area 210 at the rig floor to be redeployed into the well quickly, directly from the vertical storage areas 190, 210, without necessity of retrieval from a distant, horizontal rack (which is typical in the prior art). These operations provide use of a rack-back 190 which would ordinarily form part of a monkey-board 200, without having a requirement to have a man on the monkeyboard 200 above the well-head, which is dangerous and not permitted in pressure-controlled wells.

Some exemplary distances and dimensions for some components and their interrelationships: The distance of the offset 115 of the upper rams' mounting point/hinge 120 vertically from the horizontal centre-line of the block 50 is greater than zero, and preferably about 7 inches; the extended length of the rams 160 is, in an embodiment, about 39 inches; the distance from the longitudinal center of each bail 10 and the hinge point of its link cylinder mount clamp 100 is greater than zero and preferably about 6 inches; the distance along a bail 10 from its upper eye 20 suspension point to a point opposite the hinge point in an attached cylinder mount clamp 100 is in an embodiment slightly less than the fully extended length of the rams 160; the bails' 10 total length in an embodiment is about 72 inches; a preferred angle of deflection of the bails 10 by full retraction of the rains 160 is about 70 degrees, which causes a deviation of the elevator 170 from the well's centre-line of about 64 inches. In an embodiment rig, a monkeyboard 200 is fitted with fingered guides forming a pipe rack 190 to receive the upper end of tubulars 180 withdrawn from or ready for injection into the associated wellbore, the monkeyboard 200 and rack of fingered guides 190 or pipe rack being at or just below a height which is about the length of a pipe joint (in a double joint operation, about sixty feet or 19 meters) from the floor 210 on which the tubular 180 joint rests when not in the wellbore. The system for deviating the tubing can be operated from anywhere on the rig with remote control systems, meaning that the operator does not have to be on or near the monkeyboard 200 to control the placement of tubing 180 into the pipe rack 190, nor removal of tubing 180 from the rack 190 for injection into the wellbore; this permits use of the system in pressure-controlled settings.

In an embodiment, a tubing-guide system is deployed, which is essentially a catcher-guide 140 attached to or near to the elevator 170, which provides a spoon-shaped or v-shaped guide 140A into which the upper end of a tubing joint (or double joint) 180 may fit, in order to assist in remotely aiming the elevator's 170 open jaws to receive and grasp the tubing 180. Several possible embodiments are provided for, including cast metal, shaped-tubing, cut-formed-and-welded shapes, but each of which provides a broader target than the elevator's open jaws for the operator to engage the tubing 180, which in turn guides the tubing's 180 upper end to the elevator's 170 controlled jaws. The guide 140 has a receptacle 140A size which is preferably about 1.5-2 times the outer diameter of tubulars 180 to be handled.

Small, powerful manipulable elevator systems such as this have not been deployed on completion or work-over rigs or for snubbing operations, in particular. This may be due to the common use of endless or coil tubing in the target wells. Having said that, jointed tubing is still used in workover and completion operations, and use of single-handed vertical tubular racking systems can save tremendous time and cost, and reduce downtime and turnaround, as well as being permissible under various safety regulation regimes since no personnel are required to be on the rig's monkeyboard.

The distance between the connection of the hydraulic arms 160 near the swivel 120 and the connection of the hydraulic arms 160 to the bails 10 at the connector 105 below the elevator 50 will determine the throw-distance or offset available for moving suspended tubulars 180 off vertical alignment with the well-head and to or toward vertical stacked storage 190, 210. The amount of change in length of the hydraulic arms 160 will also have some bearing on the throw distance and the angular change available. These will be optimized based upon the rig-floor and stacking area location and size, height of the tubular joints, and similar constraints.

Figure 8A:
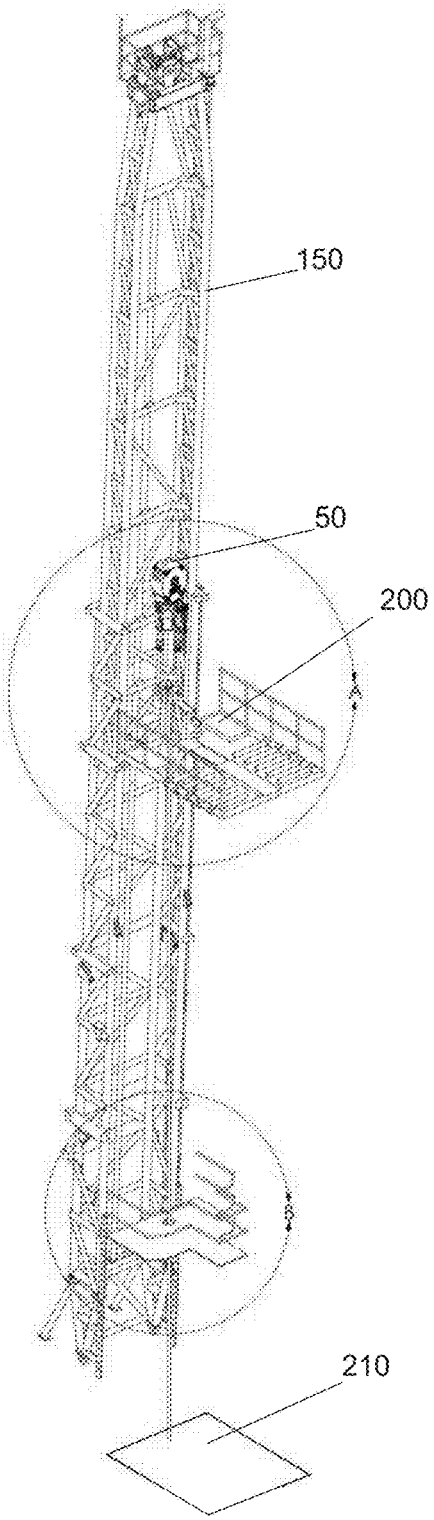
FIGS. 8 through 12 are elevations of a rig equipped with the apparatus to show the apparatus in sequential portrayals of parts of an operating cycle of the system manipulating tubulars; Figures A, B, and C of each of 8-12 are, respectively, rig view (A), expanded view of detail A (B), and expanded view of detail B, in each set of figures.
Figure 8B:
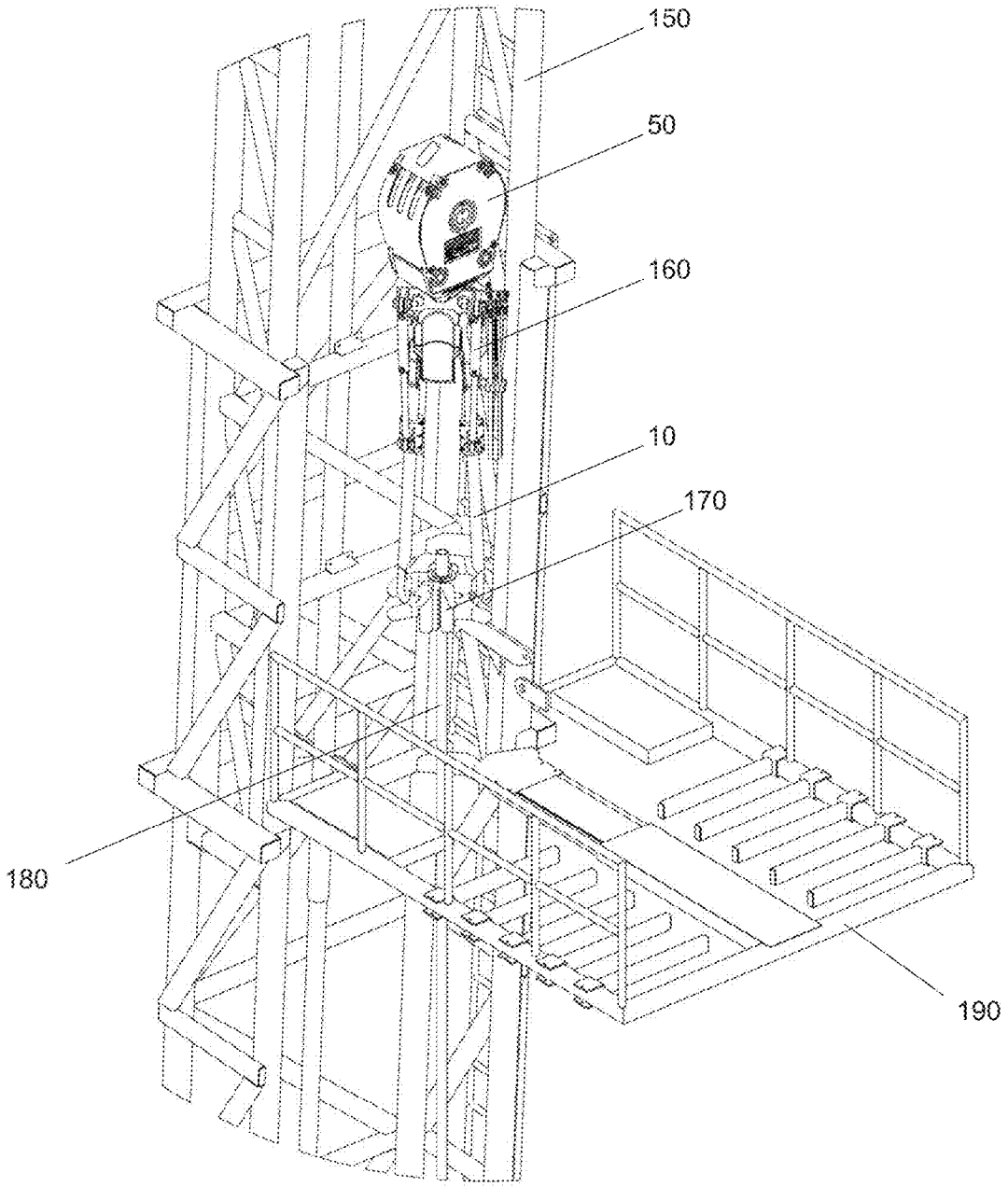
Figure 8C:
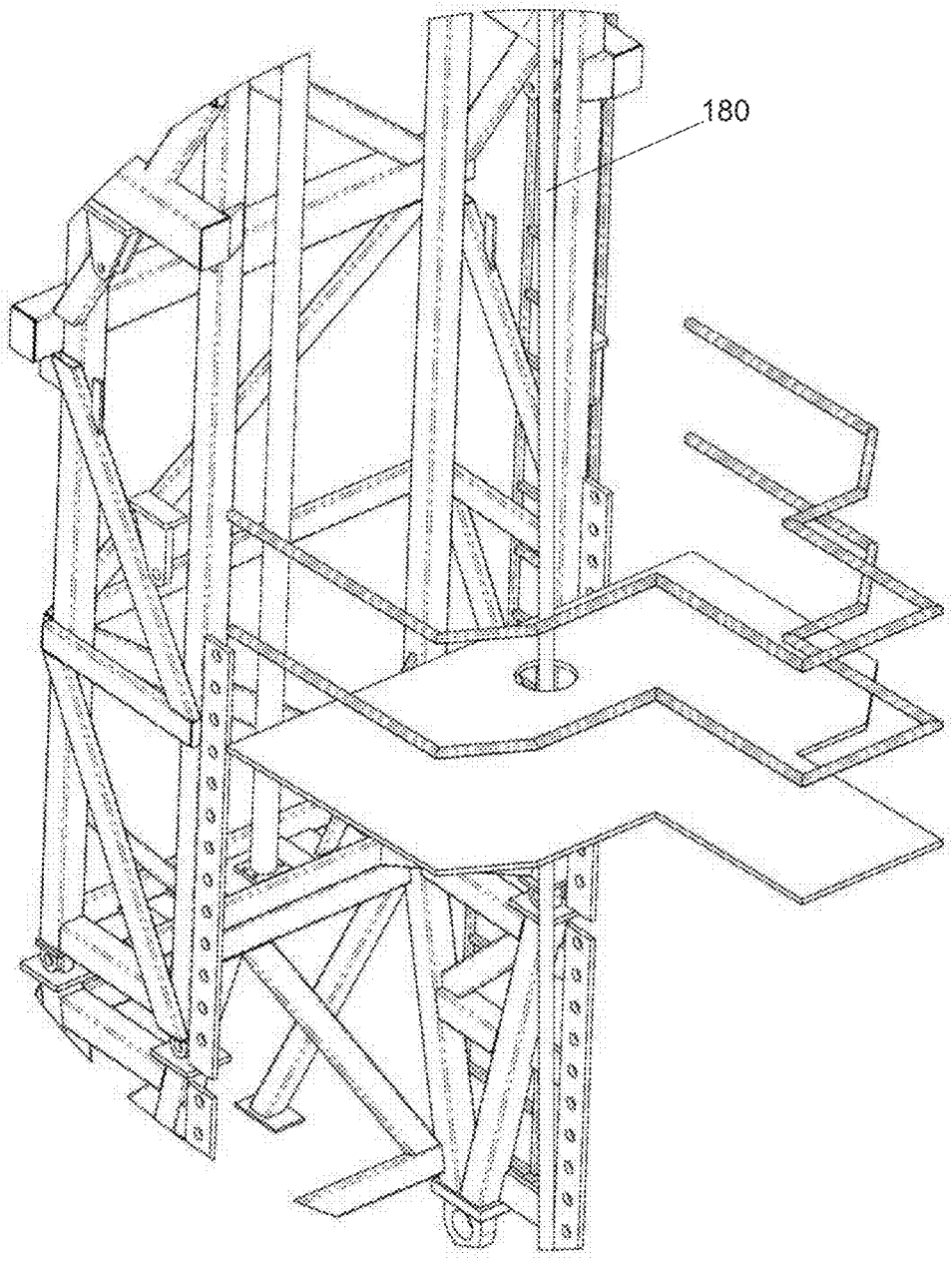
Figure 9C:
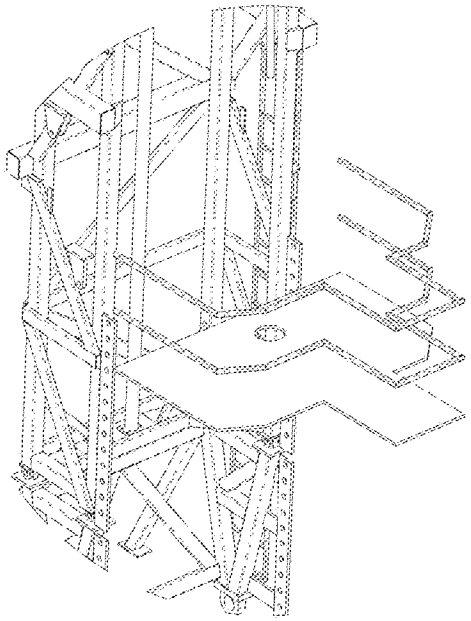
Figure 9B:
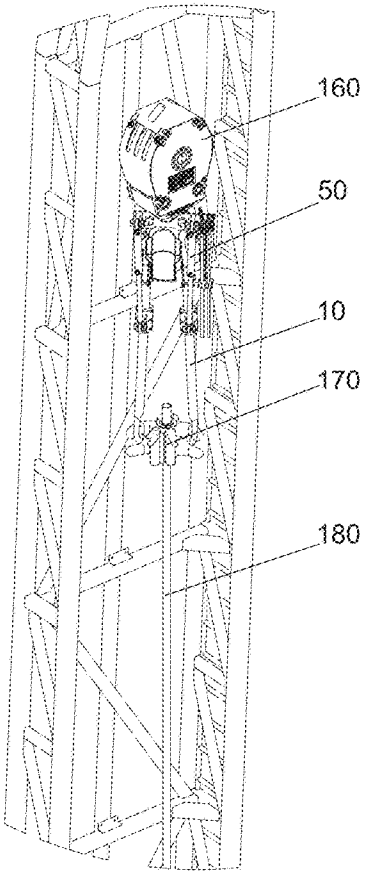
Figure 9A:
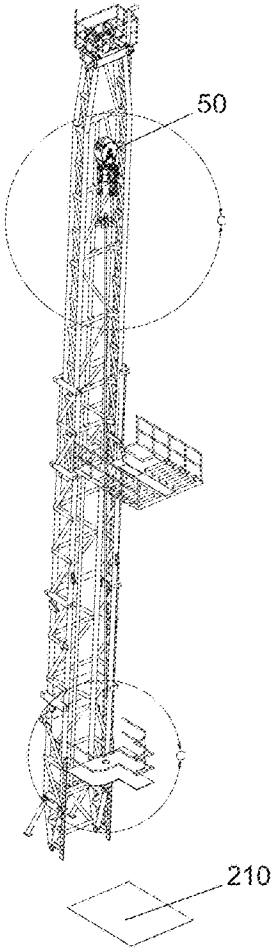
Figure 10C:
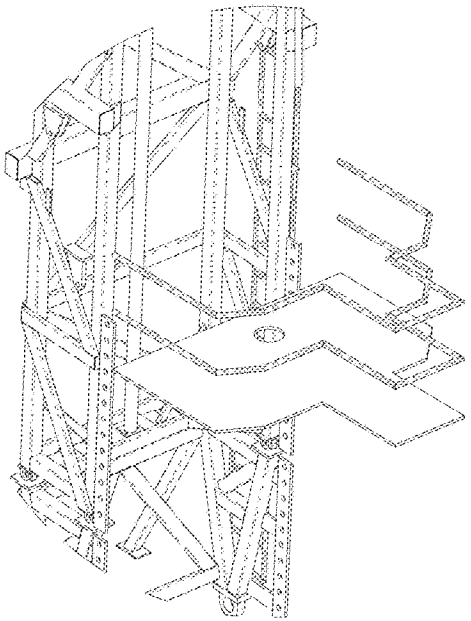
Figure 10B:
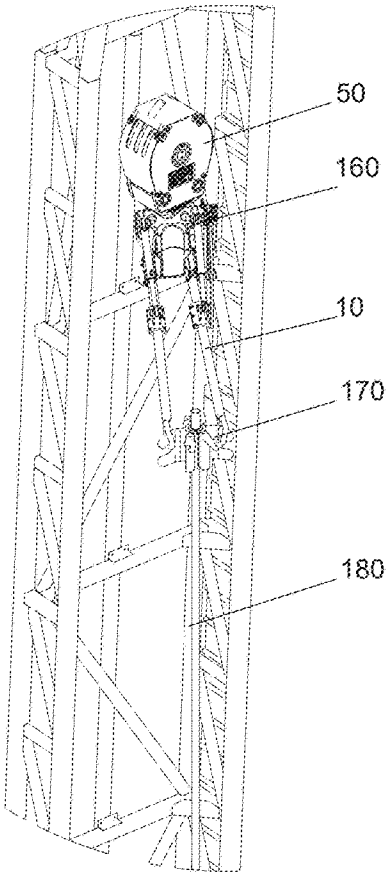
Figure 10A:
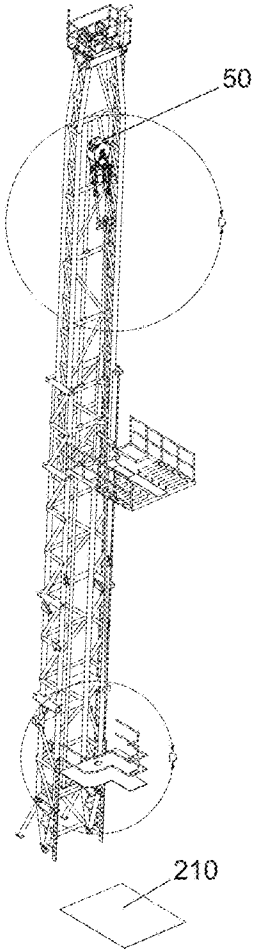
Figure 11C:
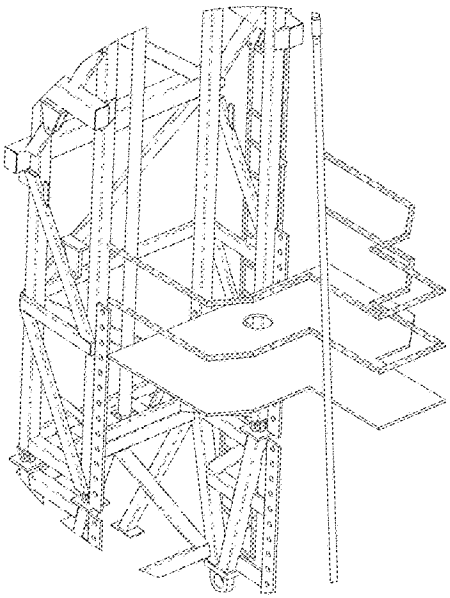
Figure 11B:
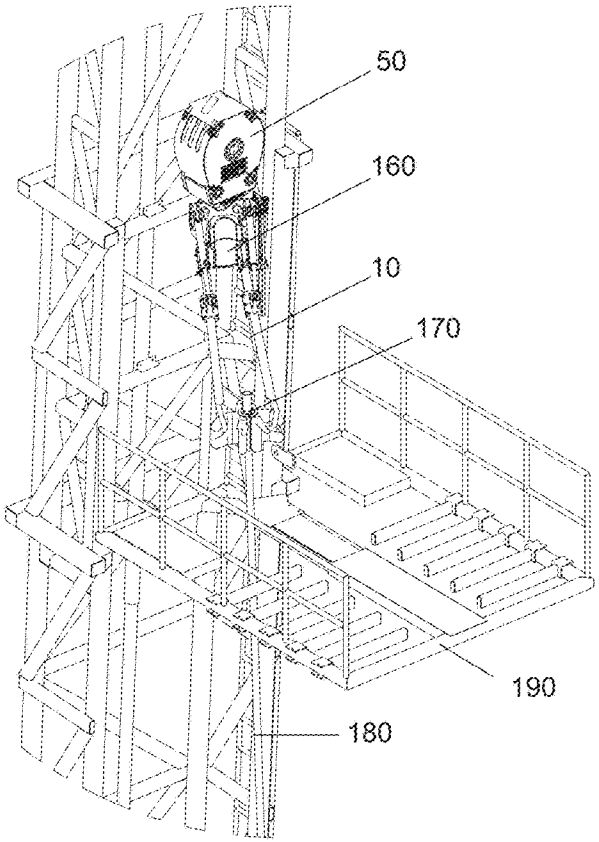
Figure 11A:
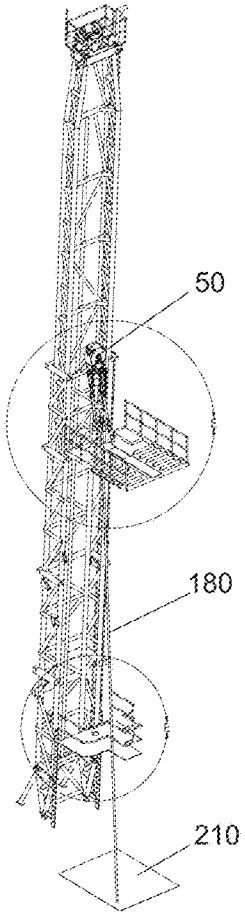
Figure 12C:
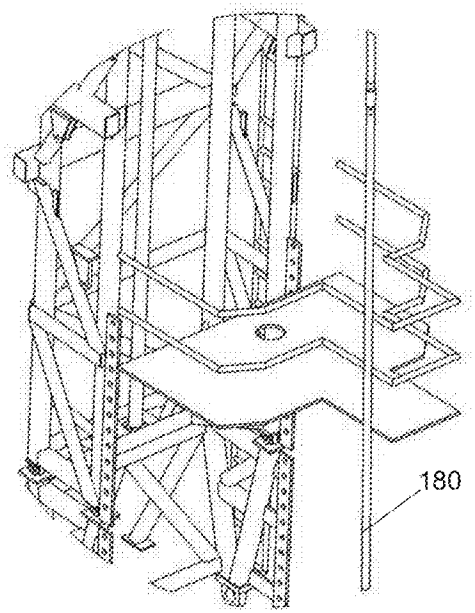
Figure 12B:
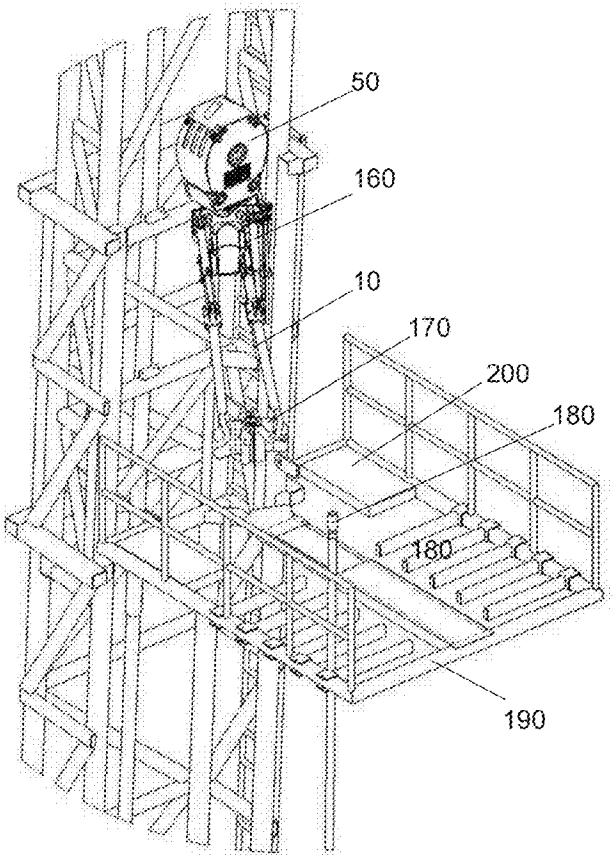
Figure 12A:
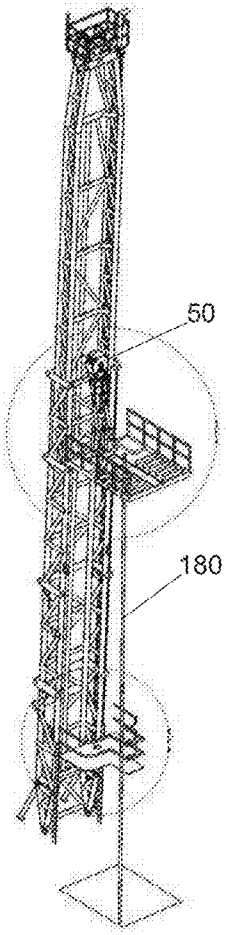

Figures in the series from 8A through 12C show a progression of the system's operation in use. FIGS. 8A-8C show the configuration on the rig's derrick 150 of the bails 10, the block 50, rams 160, and elevator 170 as aligned vertically when pulling tubular 180 from the wellbore. FIGS. 9A-9C show the tubular 180 raised more fully (with the block 50 picked up substantially higher), the subcomponents still in essentially vertical alignment. FIGS. 10A-10C show the bails 10 deflected from vertical alignment with the block 50, starting to swing the elevator 170 and grasped tubular 180 away from the well's centre-line—the tubular has been disconnected from lower tubulars still suspended in the well's bore. FIGS. 11A-11C shows the block 50 partially lowered (lowering all components and tubular 180 depending from the block) with the bails 10 deflected/rotated out from under the block, and the tubular coming to rest with its bottom end in the pipe stand 210 or landing area, and the tubular's 180 upper end (FIG. 11B) coming to rest between fingers in the pipe rack 190 on/near the monkeyboard 200—in a different interpretation, these FIGS. 11) also show the tubular 180 about to be removed from the rack 190, 210 to be stabbed (at the bottom end of the tubular 180) into the well's bore for joining with tubulars or equipment already in the well. FIGS. 12A-12C show another view of the tubular 180 being racked into the pipe rack 190, 210 by deflection of the bails 10 to move the elevator 170 into place for that operation.

The descriptions in this part are meant to be illustrative and not limiting, and it will be apparent to one skilled in the art of building or operating completion or work-over or service rigs, particularly in pressure-controlled wells, that the described arrangements of apparatus and the methods of use are merely illustrative of applications of the principles of the invention, and that many other embodiments and modifications may be made without departing from the spirit and scope of the invention as delineated by the claims.

| LEGEND FOR THE REFERENCE NUMERALS | |
|---|---|
| 10 | Bail |
| 10a | Displaced bail |
| 10b | Bail, not displaced |
| 20 | Upper Eye of Bail |
| 30 | Elongated body of Bail |
| 40 | Lower Eye of Bail |
| 50 | Travelling Block |
| 60 | Hook or Ear on or near (below) Block |
| 70 | Link Reaction Assembly |
| 80 | Link Plate |
| 90 | Link wear block |
| 95 | Link load block |
| 100 | Bail Connector Clamp to Ram Bottom End |
| 105 | Hinge point of Bail Connector Clamp |
| 110 | Vertical displacement part of connector and hinge |
| 115 | Displacement from vertical of upper ram hinge from travelling block |
| 120 | Hinge points on upper ram connector to block |
| 130 | Plate for attachment of upper ram connector to block |
| 140 | Tube guide/catcher |
| 140A | Opening distance of catcher (1.5-2X tubing diameter) |
| 150 | Derrick |
| 160 | Ram |
| 170 | Elevator |
| 180 | Tubular |
| 190 | Pipe rack |
| 200 | Monkeyboard |
| 210 | Pipe stand |

What is claimed is:

1. A manipulable elevator system for rig operations on a well to facilitate vertical racking of jointed tubulars, the system comprising:

(a) an elevator configured to grasp or release jointed tubulars;

(b) means to move the elevator and a bottom end of any grasped tubular toward or away from vertical alignment with a center line of the well; and (c) a control mechanism to control grasp/release operation of the elevator and the movement of the elevator in relation to vertical alignment with the center line of the well;

wherein the means to move the elevator and the bottom end of any grasped tubular toward or away from vertical alignment with the center line of the well comprises:

(d) a draw-works with winch, cable/tackle, an upper block and a travelling block suspended by the cable/tackle, and the elevator suspended from and below the travelling block by two bails;

(e) wherein each bail comprises an eye or fastener at an upper end of the bail, a middle elongated body, and a lower eye or fastener at a lower end of the bail;

(f) wherein the travelling block has a connector for the eye or fastener at the upper end of each bail, at or near each side of a lower end of the travelling block, for receiving the eye or fastener at the upper end of each respective bail;

(g) wherein the elevator is suspended from and attached to the lower eye or fastener of each respective bail;

(h) wherein at or near each connector of the travelling block for the eye or fasterner of a each respective bail is an off-set device, attached to the connector or to the travelling block on one side of the off-set device, and carrying a hinge-point on another side of the off-set device, the hinge-point being off-set vertically from a centre of gravity of the travelling block;

(i) wherein to each hinge-point of each off-set device is hingedly attached an upper end of a jack;

(j) wherein a lower end of each jack is attached to the middle elongated body of each respective bail, each jack being attached to its each respective bail at about the same point on the elongated body of each respective bail;

(k) the control mechanism configured to remotely operate and power the jacks to extend or retract, to cause movement of the suspended elevator and the bottom end of any grasped tubular away from or toward vertical alignment with the center line of the well; and the elevator system having an added tubing capture-guide comprising a trough, spoon or v-shaped guide mounted on or near the travelling block at about the same level as the lower end of the travelling block and about level with the upper eyes of the bails, to guide an upper end of a joint or double joint of a jointed tubular toward and into the elevator when the elevator is used to pick up tubing from a vertical rack near to but offset from the center line of the well.

2. The elevator of system claim 1 where remote operations are controlled away from a monkeyboard of the rig.

3. The elevator system of claim 1 where the elevator is hydraulically powered and controlled.

4. The elevator system of claim 1 where an extension or a retraction of the jacks is powered and controlled hydraulically.

5. The elevator system of claim 1 where there is an alignment and retention device deployed between the upper eye of each bail and the connector of the travelling block from which the bail is suspended, comprising:

(a) A plate with a mating plate, the two plates attached to opposite sides of the upper eye of a that bail, and between which is affixed a compressible spacer; and (b) The spacer is sized and placed to fill or nearly fill the gap between a lower inner surface of the connector, and an upper inner surface of the eye of that bail.

* * * * *